US009847080B2

(12) United States Patent
Chapman

(10) Patent No.: US 9,847,080 B2
(45) Date of Patent: Dec. 19, 2017

(54) SYSTEM AND METHOD FOR SWITCHING SOUND PICKUPS IN AN ELECTRIC GUITAR USING A SPIN WHEEL ARRANGEMENT

(71) Applicant: Joseph Chapman, Bellville, OH (US)

(72) Inventor: Joseph Chapman, Bellville, OH (US)

( * ) Notice: Subject to any disclaimer, the term of this patent is extended or adjusted under 35 U.S.C. 154(b) by 0 days.

(21) Appl. No.: 14/751,163

(22) Filed: Jun. 26, 2015

(65) Prior Publication Data

US 2015/0294659 A1 Oct. 15, 2015

(51) Int. Cl.

| | |
|---|---|
| ***G10H 3/18*** | (2006.01) |
| ***G10H 3/14*** | (2006.01) |
| ***G10H 1/32*** | (2006.01) |
| ***G10D 1/08*** | (2006.01) |

(52) U.S. Cl.

CPC ..... *G10H 3/183* (2013.01); *G10D 1/085* (2013.01); *G10H 1/32* (2013.01); *G10H 3/14* (2013.01); *G10H 3/18* (2013.01); *G10H 3/181* (2013.01); *G10H 3/182* (2013.01); *G10H 2220/505* (2013.01)

(58) Field of Classification Search

CPC ..... G10H 3/18; G10H 3/183; G10H 3/181; G10H 3/182; G10H 3/14; G10H 1/32; G10D 1/085

USPC ..... 84/743, 726, 727

See application file for complete search history.

(56) References Cited

U.S. PATENT DOCUMENTS

| | | | | | |
|---|---|---|---|---|---|
| 3,544,696 | A * | 12/1970 | Broussard | G10D 1/085 | 84/726 |
| 3,780,202 | A * | 12/1973 | Law | G10H 3/183 | 84/269 |
| 3,869,952 | A * | 3/1975 | Rowe | G10H 3/183 | 84/727 |
| 4,394,830 | A * | 7/1983 | Damiano | G10D 1/085 | 84/267 |
| 4,501,186 | A * | 2/1985 | Ikuma | G10H 3/182 | 84/726 |
| 4,632,003 | A * | 12/1986 | Kopp | G10D 1/085 | 84/267 |
| 5,012,716 | A * | 5/1991 | Pagelli | G10H 3/182 | 84/727 |
| 5,292,999 | A * | 3/1994 | Tumura | G10H 3/181 | 84/728 |

(Continued)

*Primary Examiner* — David Warren
*Assistant Examiner* — Christina Schreiber
(74) *Attorney, Agent, or Firm* — Barry Choobin; Patent 360

(57) ABSTRACT

The embodiments herein provide a system and method for instantly switching sound pickups in an electric guitar using a spin wheel arrangement in the middle of a song. The spin wheel houses a pickup assembly with multiple pickups. The spin wheel allows a guitar player to easily roll neck pickup to bridge position and bridge pickup to neck position in middle of a song by rotating the spin wheel. A click stop arrangement halts wheel rotation after completing a semi-circular rotation around a center screw. The backend portion of pickups is connected to spring loaded plunger. The contact pads at bottom portion of guitar body establishes electrical connections between pickups and control components. The pickups under the strings get activated. The spin wheel arrangement allows a guitar player to add favorite pickups for generating various tonalities beyond the limit of a single guitar.

3 Claims, 10 Drawing Sheets

(56) References Cited

U.S. PATENT DOCUMENTS 5,335,576 A * 8/1994 Hayashi ..... G10H 3/181 84/727
5,637,823 A * 6/1997 Dodge ..... G10H 1/32 84/726
D393,275 S * 4/1998 Andrenacci ..... D17/20
5,767,432 A * 6/1998 Randolph ..... G10D 1/085 84/267
6,043,422 A * 3/2000 Chapman ..... G10H 1/32 84/723
6,162,984 A * 12/2000 Engard ..... G10H 3/183 84/743
7,015,390 B1 * 3/2006 Rogers ..... G10H 1/32 84/1
7,060,888 B2 * 6/2006 Spalt ..... G10H 3/183 84/727
7,285,714 B2 * 10/2007 Juszkiewicz ..... G10H 3/181 84/298
9,093,058 B1 * 7/2015 Harris ..... G10H 3/181
2003/0164080 A1 * 9/2003 Childress ..... G10D 1/00 84/291
2004/0245080 A1 * 12/2004 Turner ..... G10H 3/182 200/329
2006/0174755 A1 * 8/2006 Ito ..... G10H 3/182 84/724
2011/0290099 A1 * 12/2011 Franklin ..... G10H 3/182 84/733
2012/0312146 A1 * 12/2012 Bekerman ..... G10H 3/143 84/726
2013/0263721 A1 * 10/2013 Shavit ..... G10H 1/055 84/626
2013/0276621 A1 * 10/2013 Bekerman ..... G10H 1/32 84/726
2014/0251117 A1 * 9/2014 Angelopoulos ..... G10H 3/18 84/726
2015/0294659 A1 * 10/2015 Chapman ..... G10H 3/183 84/743
2016/0049142 A1 * 2/2016 Radmacher ..... G10H 3/181 84/726

* cited by examiner

SYSTEM AND METHOD FOR SWITCHING SOUND PICKUPS IN AN ELECTRIC GUITAR USING A SPIN WHEEL ARRANGEMENT

BACKGROUND

Technical Field

The embodiments herein are generally related to musical instruments. The embodiments herein are particularly related to electric guitars. The embodiments herein are more particularly related a system and method for instantly switching sound pickups in an electric guitar using a spin wheel arrangement while playing the electric guitar. The embodiments herein are also related to a system and method for providing a spin wheel arrangement in an electric guitar to allow a guitar player to add favorite pickups for generating a plurality of tones beyond a limit of a single guitar.

Description of the Related Art

Electric guitars are popular musical instruments capable of producing a wide range of sounds using an amplification device. A traditionally built electric guitar comprises one or more permanently installed pickups which are positioned beneath the metal strings. In general, the pickups are situated between an end of the neck's finger board and a bridge of the guitar. Each pickup is typically composed of a single coil having two wires connectable to a guitar output circuit. The output circuit is connected to an audio amplifier through a shielded two conductor cable.

The pickups captures a sound of a vibrating metal string and converts the mechanical vibrations to electrical signals. Magnetic pickups consists of a permanent magnet with a core made up of a material such as alnico or ceramic wrapped with a coil of several thousand turns of finely enameled copper wire. A disturbance in the magnetic field, produced by the vibrating string causes the coil of wire wound around the magnet to become a conductor for a flow of current. The current flow creates an electrical signal that is transmitted to a loudspeaker system after amplification.

Electric guitars normally have either one coil or a double coil arranged on the sound pick-up. The double coil has two electrically separated coils. The double coil is also known as a 'humbucker pickup'. The best known pickup arrangements in the electric guitars are Gibson tonality and Fender tonality. The Gibson tonality comprises two sound pickups with a double coil whereas the Fender tonality comprises three sound pickups, each having one coil. The guitars with humbucker pickups are mostly used for producing hard rock sound or (fat sound). On the other hand, the Fender telecasters or Stratocasters are preferred for producing country sounds or twang.

Historically, many musicians desire to play the guitars that generate tonalities beyond the limit of a single guitar. For example, while playing a guitar with single coil pickups, musicians want to change the sound to another pick-up like a hum bucker, or p-90 or a Minnie hum bucker. Some of the existing systems allows the musicians to do hardware modifications of a specific component to achieve different tonality in same instrument. A single coil sound is achieved from a humbucker pickup by connecting one of the coils in the humbucker to ground. In this case, even though a single coil sound is produced, the humbucker does not produce a standalone single coil sound. Moreover, these systems limit a capability of a musician to dynamically alter the tonal characteristics. In some other existing systems, active electronics, new and different knobs or buttons, and switches are used to produce entirely new tones. But, such systems are hard-to-use and needs additional care while using the guitar.

Hence, there is a need for a system and method for instantly switching sound pickups in an electric guitar using a simple spin wheel arrangement while playing the electric guitar. Further, there is a need for a system and method for providing a spin wheel arrangement in an electric guitar that allows a guitar player to add favorite pickups for generating a plurality of tonalities beyond the limit of a single guitar. There is also a need for a system and method for easily rolling a neck pickup of the electric guitar to a bridge position and bridge pickup of the electric guitar to a neck position instantly in the middle of a song.

The above mentioned shortcomings, disadvantages and problems are addressed herein and which will be understood by reading and studying the following specification.

OBJECT OF THE EMBODIMENTS

The primary object of the embodiments herein is to provide a system and method for instantly switching a sound pickups in an electric guitar using a spin wheel arrangement in a middle of a song.

Another object of the embodiments herein is to provide a spin wheel arrangement in an electric guitar that allows a guitar player to add favorite pickups for generating a plurality of tonalities beyond the limit of a single guitar.

Yet another object of the embodiments herein is to provide a system and method for easily rolling a neck pickup of the electric guitar to a bridge position and bridge pickup of the electric guitar to a neck position instantly in a middle of a song.

Yet another object of the embodiments herein is to provide a spin wheel arrangement in an electric guitar that generates a plurality of tonalities with combinations of all single coils or all hum buckers or both.

These and other objects and advantages of the embodiments herein will become readily apparent from the following detailed description taken in conjunction with the accompanying drawings.

SUMMARY

The following details present a simplified summary of the embodiments herein to provide a basic understanding of the several aspects of the embodiments herein. This summary is not an extensive overview of the embodiments herein. It is not intended to identify key/critical elements of the embodiments herein or to delineate the scope of the embodiments herein. Its sole purpose is to present the concepts of the embodiments herein in a simplified form as a prelude to the more detailed description that is presented later.

The other objects and advantages of the embodiments herein will become readily apparent from the following description taken in conjunction with the accompanying drawings.

The embodiments herein provide a system and a method for switching sound pickups in an electric guitar during a plying of a song to allow a guitar player to add a desired sound pickup for generating a plurality of tonalities which lies beyond a limit of a single guitar.

According to an embodiment herein, a system is provided for switching sound pickups in an electric guitar. The system comprises a guitar body, a guitar bridge mounted on the guitar body, and a finger board with a head stock. The finger board is extended from the guitar body. A plurality of guitar strings is provided on the guitar body. A first end of each guitar strings is tied to the guitar bridge using a knot and a second end of each guitar strings is wound around a round cylinder of the head stock. A spin wheel assembly mounted on the guitar body. The spin wheel assembly is positioned between the guitar bridge and the finger board. A pick-up assembly is mounted on the spin wheel assembly. A click-stop mechanism is mounted on the guitar main body and configured to stop a rotation of a spin wheel assembly, when the spin wheel assembly completes a semi-circular rotation.

According to an embodiment herein, the spin wheel assembly switches a sound pickup in the electric guitar during a plying of a song. The spin wheel assembly is rotated during the playing of the song to switch the sound pick-up. The spin wheel assembly allows a guitar player to add a desired sound pickup for generating a plurality of tonalities. The plurality of tonalities lies beyond a limit of a single guitar. The spin wheel assembly rolls a neck pickup of the electric guitar to a bridge position. The spin wheel assembly rolls bridge pickup of the electric guitar to a neck position.

According to an embodiment herein, the spin wheel assembly comprises a spin wheel. The spin wheel comprises a top plate and a bottom plate. The top plate and the bottom plate of the spin wheel are held together with a plurality of screws. The top plate is mounted with a pickup assembly and the bottom plate is mounted with a plurality of spring loaded plungers.

According to an embodiment herein, the guitar body comprises a circular groove for fixing the spin wheel on the guitar body. The circular groove is arranged in such a manner to form a center stub in the guitar body. The spin wheel is fixed on the guitar body under the guitar strings with a center screw. The center screw is configured to act as an axis of rotation for the spin wheel. The circular groove comprises a pair of contact holes. Each contact hole is provided with a contact pad at a bottom portion.

According to an embodiment herein, the pickup assembly comprises a plurality of pickups positioned along a horizontal axis and a plurality of pickups positioned along a vertical axis of the spin wheel. Each pickup is connected to the spring loaded plungers through a hot wire.

According to an embodiment herein, the pickups are placed under the guitar stings to make a contact with the contact pads through the spring loaded plungers.

According to an embodiment herein, the contact pads are configured to establish electrical connections between the pickups under the guitar strings and a plurality of electronic control components of the electric guitar.

According to an embodiment herein, the spring loaded plungers are made of copper.

According to an embodiment herein, the contact pads are made of copper.

According to an embodiment herein, the spin wheel is rotated in clock wise direction to switch pickups while playing a song in the electric guitar.

According to an embodiment herein, the spin wheel is rotated in a counter clock wise direction to switch pickups while playing a song in the electric guitar.

According to an embodiment herein, a method is provided for switching sound pickups in an electric guitar using a spin wheel assembly. The method comprising the steps of rotating a spin wheel by a guitar player while playing the electric guitar; halting a rotation of the spin wheel using a click stop mechanism mounted on the guitar, when the spin wheel completes a half circle rotation around a center screw to switch sound pickups which are placed under guitar strings while playing the guitar; and activating the switched sound pickups by establishing an electrical connection between the switched sound pickups and electronic control components of the electric guitar through spring loaded plungers.

According to an embodiment herein, wherein the rotation of spin wheel assembly allows a guitar player to add a desired sound pickup for generating a plurality of tonalities, and wherein the plurality of tonalities lies beyond a limit of a single guitar.

According to an embodiment herein, the spin wheel rotation is halted by using a click stop arrangement in the electric guitar.

According to an embodiment herein, the electrical connection is established when the spring loaded plungers of the new pickups make contact with contacts pads of the electric guitar.

According to an embodiment herein, the spin wheel assembly rolls a neck pickup of the electric guitar to a bridge position and to add a desired sound pickup for generating a plurality of tonalities.

According to an embodiment herein, the spin wheel assembly rolls bridge pickup of the electric guitar to a neck position to add a desired sound pickup for generating a plurality of tonalities.

According to an embodiment herein, the spin wheel is rotated in clock wise direction to switch pickups while playing the electric guitar.

According to an embodiment herein, the spin wheel is rotated in anti-clock wise direction to switch pickups while playing the electric guitar.

According to an embodiment herein, the method further comprises replacing the spin wheel of the electric guitar with a new spin wheel by removing a center screw of the spin wheel.

These and other aspects of the embodiments herein will be better appreciated and understood when considered in conjunction with the following description and the accompanying drawings. It should be understood, however, that the following descriptions, while indicating preferred embodiments and numerous specific details thereof, are given by way of illustration and not of limitation. Many changes and modifications may be made within the scope of the embodiments herein without departing from the spirit thereof, and the embodiments herein include all such modifications.

BRIEF DESCRIPTION OF THE DRAWINGS

The other objects, features and advantages will occur to those skilled in the art from the following description of the preferred embodiment and the accompanying drawings in which.

Figure 1:
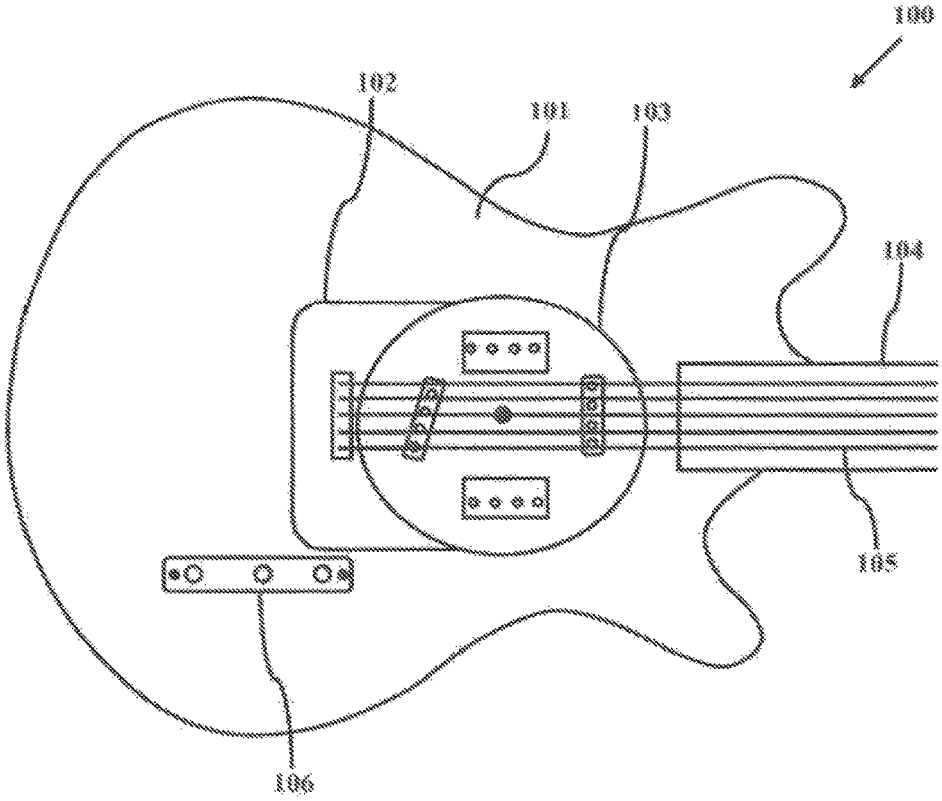
FIG. 1 illustrates a top plane view of an electric guitar fitted with a spin wheel arrangement, according to an embodiment herein.

Although the specific features of the embodiments herein are shown in some drawings and not in others. This is done for convenience only as each feature may be combined with any or all of the other features in accordance with the embodiment herein.

DETAILED DESCRIPTION OF THE EMBODIMENTS

The embodiments herein and the various features and advantageous details thereof are explained more fully with reference to the non-limiting embodiments that are illustrated in the accompanying drawings and detailed in the following description. Descriptions of well-known components and processing techniques are omitted so as to not unnecessarily obscure the embodiments herein. The examples used herein are intended merely to facilitate an understanding of ways in which the embodiments herein may be practiced and to further enable those of skill in the art to practice the embodiments herein. Accordingly, the examples should not be construed as limiting the scope of the embodiments herein.

In the following detailed description, a reference is made to the accompanying drawings that form a part hereof, and in which the specific embodiments that may be practiced is shown by way of illustration. The embodiments are described in sufficient detail to enable those skilled in the art to practice the embodiments and it is to be understood that the logical, mechanical and other changes may be made without departing from the scope of the embodiments. The following detailed description is therefore not to be taken in a limiting sense.

The embodiments herein provide a system and a method for switching sound pickups in an electric guitar during a plying of a song to allow a guitar player to add a desired sound pickup for generating a plurality of tonalities which lies beyond a limit of a single guitar.

According to an embodiment herein, a system is provided for switching sound pickups in an electric guitar. The system comprises a guitar body, a guitar bridge mounted on the guitar body, and a finger board with a head stock. The finger board is extended from the guitar body. A plurality of guitar strings is provided on the guitar body. A first end of each guitar strings is tied to the guitar bridge using a knot and a second end of each guitar strings is wound around a round cylinder of the head stock. A spin wheel assembly mounted on the guitar body. The spin wheel assembly is positioned between the guitar bridge and the finger board. A pick-up assembly is mounted on the spin wheel assembly. A click-stop mechanism is mounted on the guitar main body and configured to stop a rotation of a spin wheel assembly, when the spin wheel assembly completes a semi-circular rotation.

According to an embodiment herein, the spin wheel assembly switches a sound pickup in the electric guitar during a plying of a song. The spin wheel assembly is rotated during the playing of the song to switch the sound pick-up. The spin wheel assembly allows a guitar player to add a desired sound pickup for generating a plurality of tonalities. The plurality of tonalities lies beyond a limit of a single guitar. The spin wheel assembly rolls a neck pickup of the electric guitar to a bridge position. The spin wheel assembly rolls bridge pickup of the electric guitar to a neck position.

According to an embodiment herein, the spin wheel assembly comprises a spin wheel. The spin wheel comprises a top plate and a bottom plate. The top plate and the bottom plate of the spin wheel are held together with a plurality of screws. The top plate is mounted with a pickup assembly and the bottom plate is mounted with a plurality of spring loaded plungers.

According to an embodiment herein, the guitar body comprises a circular groove for fixing the spin wheel on the guitar body. The circular groove is arranged in such a manner to form a center stub in the guitar body. The spin wheel is fixed on the guitar body under the guitar strings with a center screw. The center screw is configured to act as an axis of rotation for the spin wheel. The circular groove comprises a pair of contact holes. Each contact hole is provided with a contact pad at a bottom portion.

According to an embodiment herein, the pickup assembly comprises a plurality of pickups positioned along a horizontal axis and a plurality of pickups positioned along a vertical axis of the spin wheel. Each pickup is connected to the spring loaded plungers through a hot wire.

According to an embodiment herein, the pickups are placed under the guitar stings to make a contact with the contact pads through the spring loaded plungers.

According to an embodiment herein, the contact pads are configured to establish electrical connections between the pickups under the guitar strings and a plurality of electronic control components of the electric guitar.

According to an embodiment herein, the spring loaded plungers are made of copper.

According to an embodiment herein, the contact pads are made of copper.

According to an embodiment herein, the spin wheel is rotated in clock wise direction to switch pickups while playing a song in the electric guitar.

According to an embodiment herein, the spin wheel is rotated in a counter clock wise direction to switch pickups while playing a song in the electric guitar.

According to an embodiment herein, a method is provided for switching sound pickups in an electric guitar using a spin wheel assembly. The method comprising the steps of rotating a spin wheel by a guitar player while playing the electric guitar; halting a rotation of the spin wheel using a click stop mechanism mounted on the guitar, when the spin wheel completes a half circle rotation around a center screw to switch sound pickups which are placed under guitar strings while playing the guitar; and activating the switched sound pickups by establishing an electrical connection between the switched sound pickups and electronic control components of the electric guitar through spring loaded plungers.

According to an embodiment herein, wherein the rotation of spin wheel assembly allows a guitar player to add a desired sound pickup for generating a plurality of tonalities, and wherein the plurality of tonalities lies beyond a limit of a single guitar.

According to an embodiment herein, the spin wheel rotation is halted by using a click stop arrangement in the electric guitar.

According to an embodiment herein, the electrical connection is established when the spring loaded plungers of the new pickups make contact with contacts pads of the electric guitar.

According to an embodiment herein, the spin wheel assembly rolls a neck pickup of the electric guitar to a bridge position and to add a desired sound pickup for generating a plurality of tonalities.

According to an embodiment herein, the spin wheel assembly rolls bridge pickup of the electric guitar to a neck position to add a desired sound pickup for generating a plurality of tonalities.

According to an embodiment herein, the spin wheel is rotated in clock wise direction to switch pickups while playing the electric guitar.

According to an embodiment herein, the spin wheel is rotated in anti-clock wise direction to switch pickups while playing the electric guitar.

According to an embodiment herein, the method further comprises replacing the spin wheel of the electric guitar with a new spin wheel by removing a center screw of the spin wheel.

The embodiments herein provides a system and method for instantly switching sound pickups in an electric guitar using a spin wheel arrangement in the middle of a song. According to an embodiment herein, the electric guitar comprises a guitar body, a guitar bridge, a spin wheel arrangement, a finger board, a guitar strings, and operator controls. The guitar bridge is mounted on the guitar body. The finger board is extended from the guitar body. The finger board comprises a head stock. A first end of the guitar strings is tied to the guitar bridge using knots and the second end of the guitar strings is wound around a round cylinder of the head stock. A circular groove is made into the guitar body leaving a center stub for fitting the spin wheel arrangement on the guitar body. The spin wheel arrangement is positioned between the finger board and the guitar bridge.

According to an embodiment herein, the spin wheel arrangement is fitted under the guitar strings using a center screw. The center screw acts as axis of rotation for the spin wheel arrangement. The spin wheel arrangement is made up of a top piece and a bottom piece. The top piece of the spin wheel arrangement houses a pickup assembly and the bottom piece of the spin wheel arrangement houses a plurality of spring loaded plungers. The top piece and the bottom piece of the spin wheel arrangement are held together with screws. The pickup assembly comprises a plurality of pickups positioned along a horizontal axis and a vertical axis of the spin wheel arrangement. The backend portion of each pickup is connected to the spring loaded plunger in the bottom piece of the spin wheel arrangement through a hot wire.

According to an embodiment herein, the spring loaded plungers are positioned in the bottom piece of the spin wheel arrangement is made of copper.

According to an embodiment herein, the circular groove in the guitar body comprises a pair of contact holes. The bottom portion of the contact holes comprises contact pads that establish electrical connections between the pickups and electronic control components of the guitar. The electronic control components of the guitar are connected to an audio amplifying device through a shielded two conductor cable. A plurality of operator controls is provided on a front face of the guitar body. The plurality of operator controls comprises volume control knob, and tone control knob to control a volume and tone of a sound respectively while playing the electric guitar.

According to an embodiment herein, the pickup assembly mounted on the spin wheel rotates freely under the guitar strings along with the spin wheel arrangement. The guitar body comprises a click stop arrangement that brings the rotating spin wheel arrangement to a halt position after completing a half circle rotation around the center screw. When a guitar player rotates the spin wheel arrangement either in a clock wise or in counter clock wise direction, the pickup assembly completes a half-circle rotation and comes to the halt position. In the halt position, a new pair of pickups are placed under the guitar strings. The copper plungers of the pickups under the guitar strings make contact with the contact pads of the guitar body. The contact pads mate/engage with the spring loaded plungers to establish an electrical connection between the new pickups and the electronic control components of the electric guitar. After establishing the electrical connection, the pickups under the guitar strings get activated and the pickups away from the guitar strings are completely off. Thus, the spin wheel arrangement allows a guitar player to switch the pickups in the electric guitar instantly by rotating the spin wheel in the middle of a song.

According to an embodiment herein, a guitar player easily replaces an old spin wheel with a new spin wheel by removing the center screw from the guitar body.

According to an embodiment herein, a guitar player adds favorite pickups to an existing spin wheel for generating various tonalities beyond the limit of a single guitar. For example, the pickups in the spin wheel is arranged such that the electric guitar generates a plurality of tonalities with combinations of all single coils or all hum buckers or both.

FIG. 1 illustrates a top plane view of an electric guitar fitted with a spin wheel arrangement, according to an embodiment herein. With respect to FIG. 1, the electric guitar 100 comprises guitar body 101, guitar bridge 102, spin wheel 103, finger board 104, guitar strings 105, and operator controls 106.

With respect to FIG. 1, the guitar bridge 102 is mounted on the guitar body 101. The finger board 104 is extended from the guitar body 101. The finger board comprises a head stock. The first ends of the guitar strings 105 are tied to the guitar bridge 102 using knots and the second ends of the guitar strings 105 are wound around a round cylinder of the head stock. A circular groove is made into the guitar body 101 leaving a center stub for fitting the spin wheel 103 on the guitar body 101. The spin wheel 103 is positioned between the finger board 104 and the guitar bridge 102.

According to an embodiment herein, the spin wheel 103 is fitted under the guitar strings 105 using a center screw. The center screw acts as axis of rotation for the spin wheel 103. The spin wheel 103 is made up of a top piece and a bottom piece. The top piece of the spin wheel 103 houses a pickup assembly and the bottom piece of the spin wheel 103 houses the spring loaded plungers. The top piece and the bottom piece of the spin wheel 103 are held together with screws. The pickup assembly comprises a plurality of pickups positioned along a horizontal axis and a vertical axis of the spin wheel 103. The backend portion of each pickup is connected to the spring loaded plunger in the bottom piece of the spin wheel 103 through a hot wire.

According to an embodiment herein, the spring loaded plungers positioned in the bottom piece of the spin wheel 103 is made of copper.

According to an embodiment herein, the circular groove in the guitar body 101 comprises a pair of contact holes. The bottom portion of the contact holes comprises contact pads to establish electrical connections between the pickups and electronic control components of the guitar 100. The electronic control components of the guitar 100 are connected to an audio amplifying device through a shielded two conductor cable. The operator controls 106 are provided on a front face of the guitar body 101. The operator controls 106 comprises volume control knob and tone control knob to control the volume and tone of a sound while playing the electric guitar 100.

According to an embodiment herein, the pickup assembly mounted on the spin wheel 103 rotates freely under the guitar strings 105 along with the spin wheel 103. The guitar body 101 comprises a click-stop arrangement that brings the rotating spin wheel 103 to a halt position after completing a half circle/circular rotation around the center screw. When a guitar player rotates the spin wheel 103 either in a clock wise or in a counter clock wise direction, the pickup assembly completes half circle/semi-circular rotation and comes to the halt position. In the halt position, a new pair of pickups are placed under the guitar strings 105. The copper plungers of the pickups under the guitar strings 105 make a contact with the contact pads of the guitar body 101. The contact pads mate with the spring loaded plungers and establish an electrical connection between the new pickups and the electronic control components of the electric guitar 100. After establishing the electrical connection, the pickups under the guitar strings get activated and the pickups away from the guitar strings 105 are completely off. Thus, the spin wheel arrangement 103 allows a guitar player to switch the pickups in the electric guitar 100 instantly by rotating the spin wheel 103 in the middle of a song.

According to an embodiment herein, a guitar player easily replaces an old spin wheel with a new spin wheel by removing the center screw from the guitar body 101.

According to an embodiment herein, a guitar player adds favorite pickups to an existing spin wheel 103 for generating a plurality of tonalities beyond the limit of a single guitar. For example, the pickups in the spin wheel 103 is arranged such that the electric guitar 100 generates tonalities with combinations of all single coils or all hum buckers or both.

Figure 2:
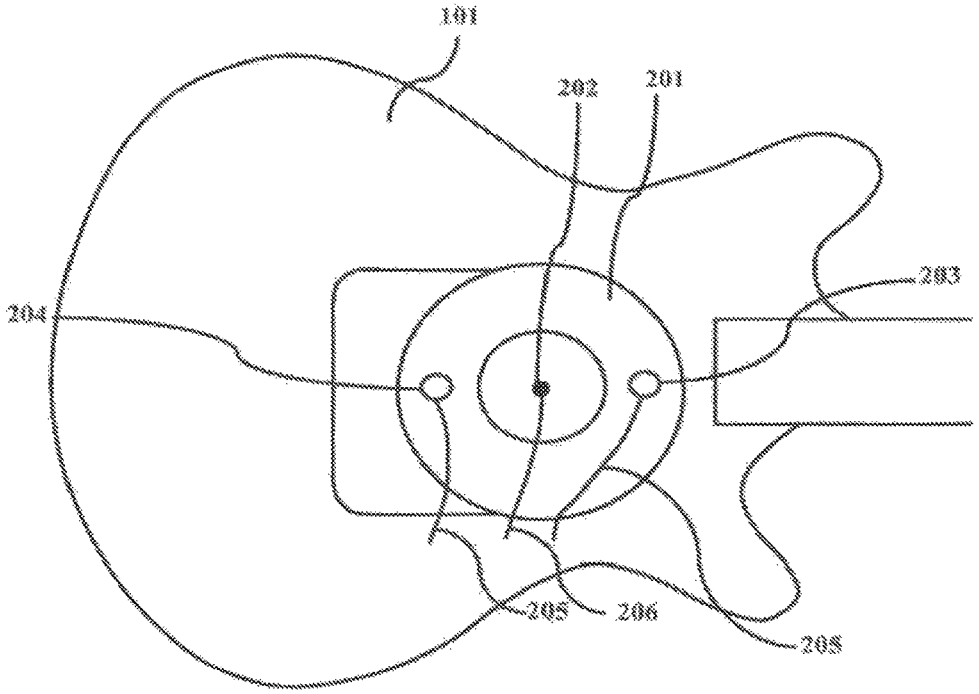
FIG. 2 illustrates a top plane view of an electric guitar with a circular groove in the guitar body for fitting a spin wheel, according to an embodiment herein.

FIG. 2 illustrates a top plane view of an electric guitar with a circular groove in the guitar body for fitting a spin wheel, according to an embodiment herein. With respect to FIG. 2, the electric guitar comprises guitar body 101, circular groove 201, center screw 202, contact holes 203 and 204, hot wires 205, and ground wire 206. The circular groove 201 is routed/formed into the guitar body 101 leaving a center stub for fitting the spin wheel. The spin wheel is fitted into the circular groove 201 using the center screw 202. The bottom portion of the contact holes 203 and 204 comprise contact pads that mate with copper plungers of the pickups in the spin wheel. The contact pads establish electrical connections between the pickups and the electronic control components of the guitar.

According to an embodiment herein, the contact pads in the bottom portion of the contact holes 203 and 204 are made of copper. The hot wire 205 from the contact hole 203 leads to electronic control components of the neck or front pickup of the guitar. The hot wire 205 from the contact hole 204 leads to electronic control components of the bridge or back pickup of the guitar. The ground wire 206 is connected from each pickup to a ground plate through the center screw 202.

According to an embodiment herein, all the hot wires 205 and ground wires 206 are embedded under a Plexiglas bottom of the electric guitar.

Figure 3:
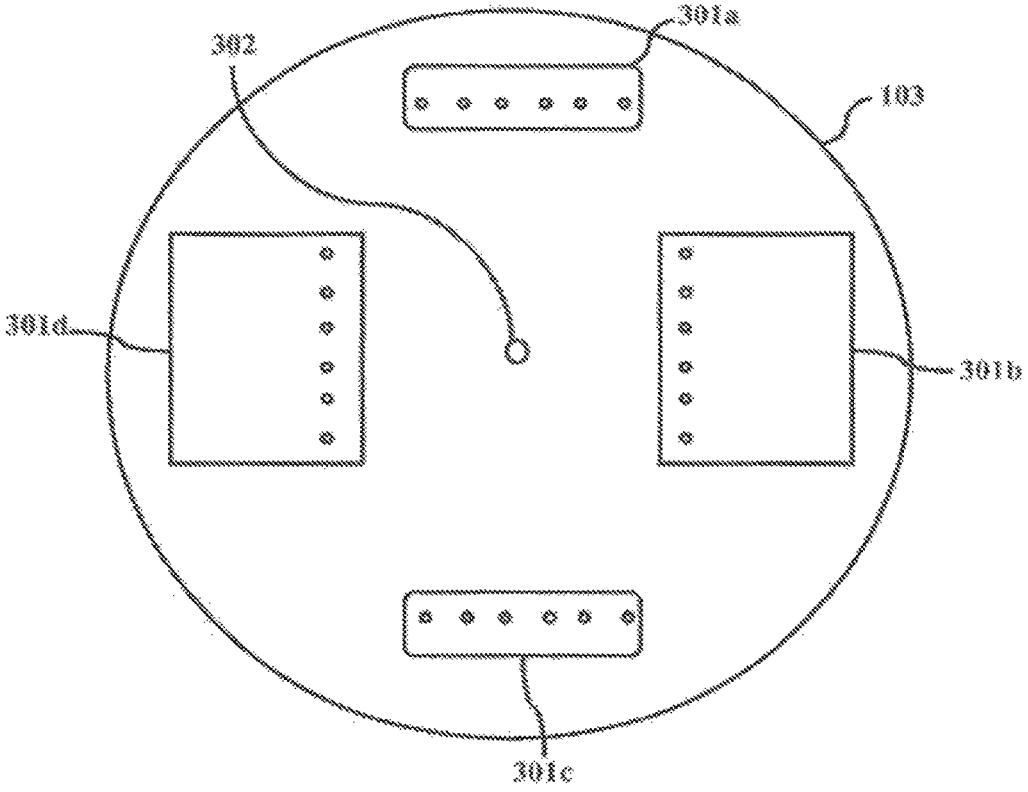
FIG. 3 illustrates a top view of a spin wheel arrangement in an electric guitar mounted with a pickup assembly, according to an embodiment herein.

FIG. 3 illustrates a top view of a spin wheel in an electric guitar mounted with a pickup assembly, according to an embodiment herein. With respect to FIG. 3, the pickup assembly of the spin wheel 103 comprises various pickups 301*a*, 301*b*, 301*c*, 301*d* with a center screw hole 302. The pickups 301*a*, 301*c* are positioned along the vertical axis of the spin wheel 103. The pickups 301*b*, 301*d* are positioned along the horizontal axis of the spin wheel 103. The conductors from each pickup are wired to the spring loaded plungers using hot pickup wires.

Figure 4:
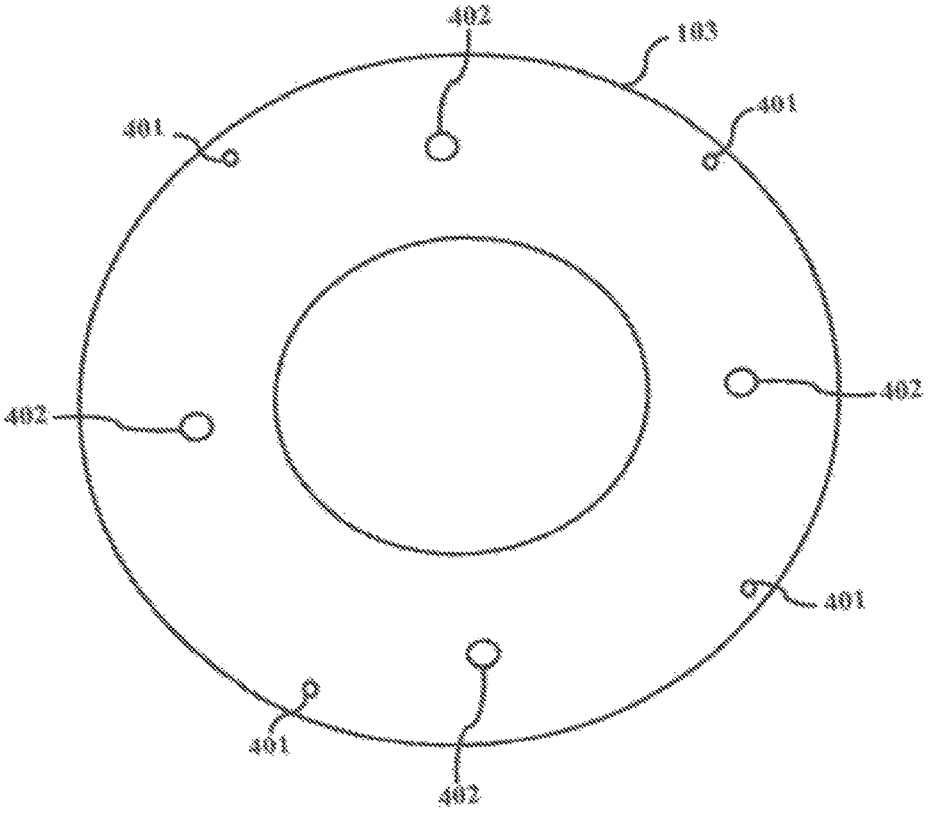
FIG. 4 illustrates a bottom view of a spin wheel arrangement in an electric guitar, according to an embodiment herein.

FIG. 4 illustrates a bottom view of a spin wheel in an electric guitar, according to an embodiment herein. With respect to FIG. 4, the bottom view of the spin wheel 103 comprises the plurality of screws 401, and the plurality of spring loaded copper studs or spring loaded plungers 402. The screws 402 holds the top piece and bottom piece of the spin wheel 103 together in the circular groove. The spring loaded plungers 402 allow the pickups to mate with the contact pads of the guitar body.

Figure 5:
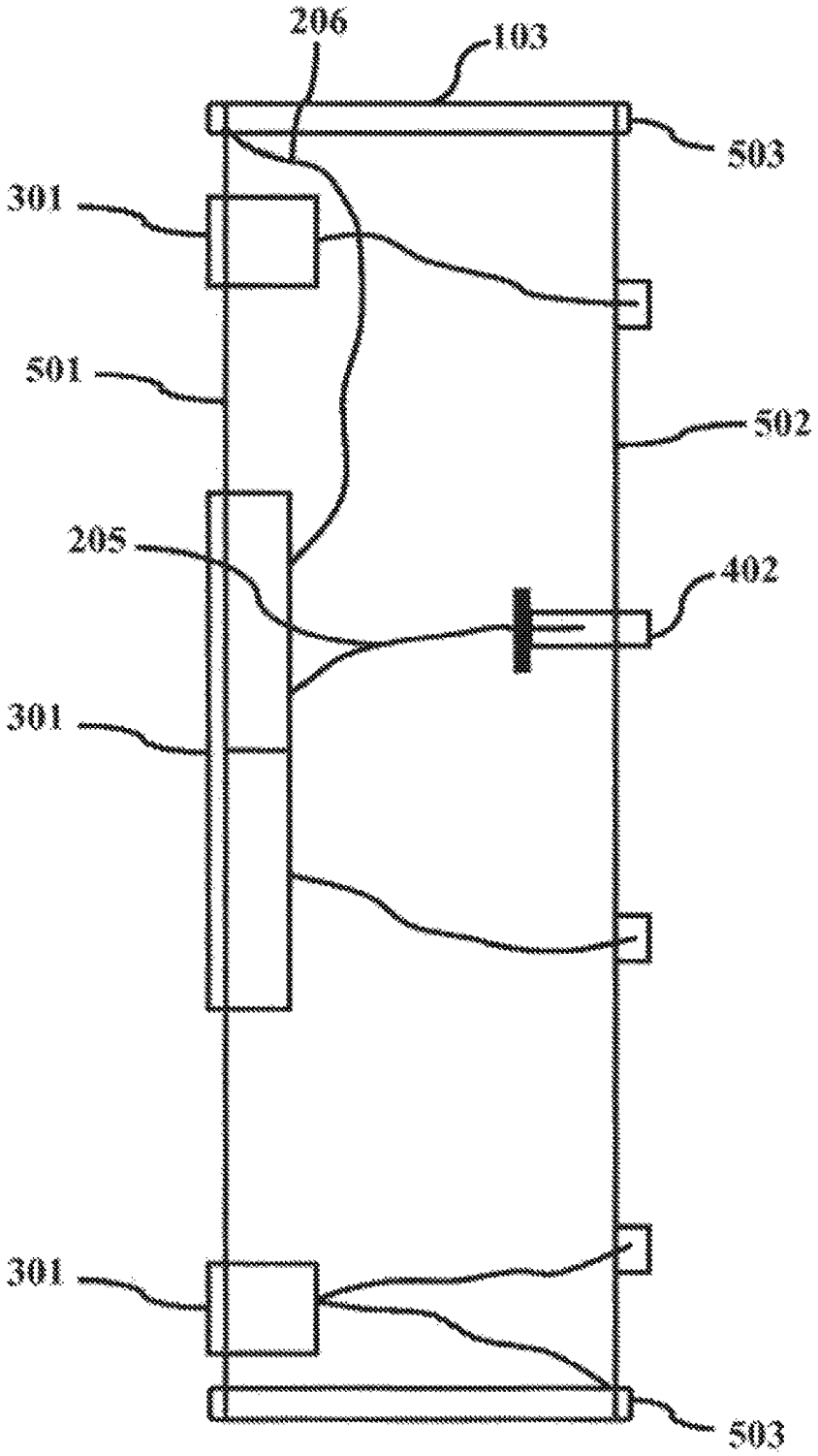
FIG. 5 illustrates a side view of a spin wheel arrangement in an electric guitar, according to an embodiment herein.

FIG. 5 illustrates a side view of a spin wheel in an electric guitar, according to an embodiment herein. The side view of the spin wheel 103 comprises top piece 501, bottom piece 502, pickups 301 mounted on the spin wheel 103, hot wires 205, ground wires 206, spring loaded plunger 402, and spacers 503. The spin wheel 103 is made up of the top piece 501 and the bottom piece 502. The top piece 501 houses the pickup assembly 301 and the bottom piece houses the spring loaded plungers 402. The spacers 503 are unthreaded sleeves that fit over bolts or screws to maintain space between the top piece 501 and the bottom piece 502 of the spin wheel 103. The hot wires 205 are connected from each pickup 301 on the pickup assembly to the electronic control components of the corresponding pickup inside the guitar.

According to an embodiment herein, the spring loaded plungers 402 are made of copper.

Figure 6:
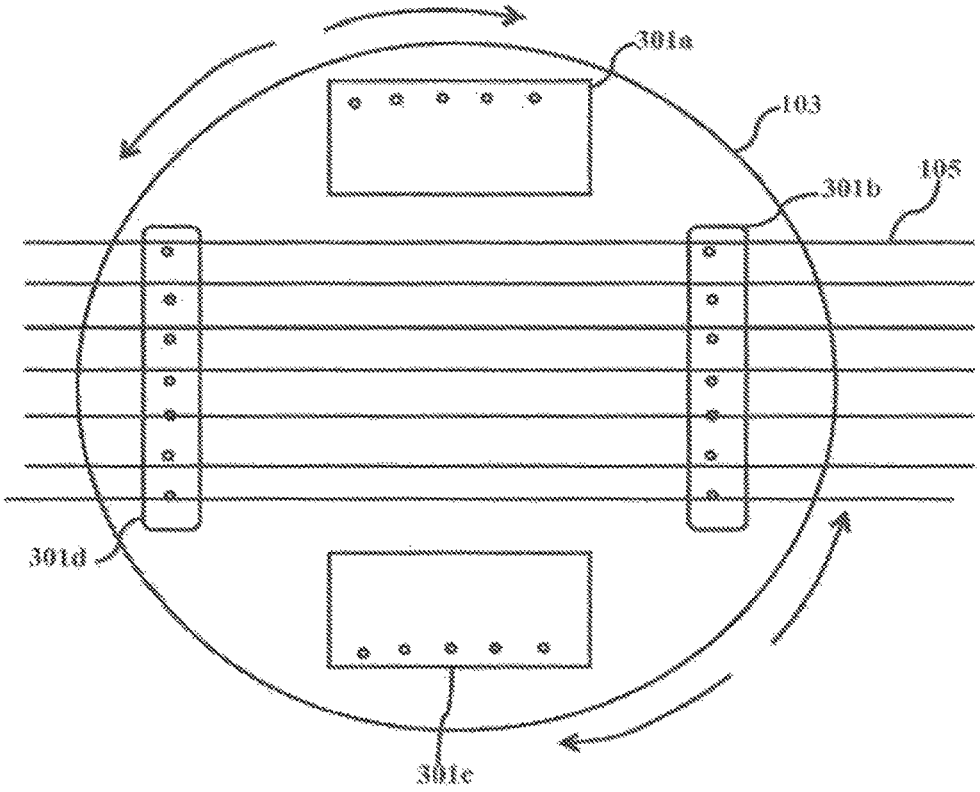
FIG. 6 illustrates a top view of a spin wheel arrangement in an electric guitar while rotating the spin wheel under guitar strings, according to an embodiment herein.

FIG. 6 illustrates a top view of a spin wheel in an electric guitar while rotating the spin wheel under guitar strings, according to an embodiment herein. With respect to FIG. 6, the spin wheel 103 is fitted to the guitar body through a center screw. The pickup assembly of the spin wheel 103 comprises various pickups 301*a*, 301*b*, 301*c*, 301*d* positioned along the horizontal axis and vertical axis of the spin wheel 103. The pickups 301*b* 301*d* are positioned under the guitar strings 103. When a guitar player rotates the spin wheel 103 either in clock wise or in anti-clock wise direction, a click stop arrangement brings the rotating spin wheel 103 to a halt position after completing a half circle/circular rotation around the center screw. In the halt position, the pickups 301*a*, 301*c* are placed under the guitar strings 105. The copper plungers of the pickups 301*a* and 301*d* make contact with the contact pads of the guitar body. The contact pads mate with the spring loaded plungers and establish an electrical connection between the pickups 301*a* and 301*d* and the electronic control components of the guitar.

Figure 7:
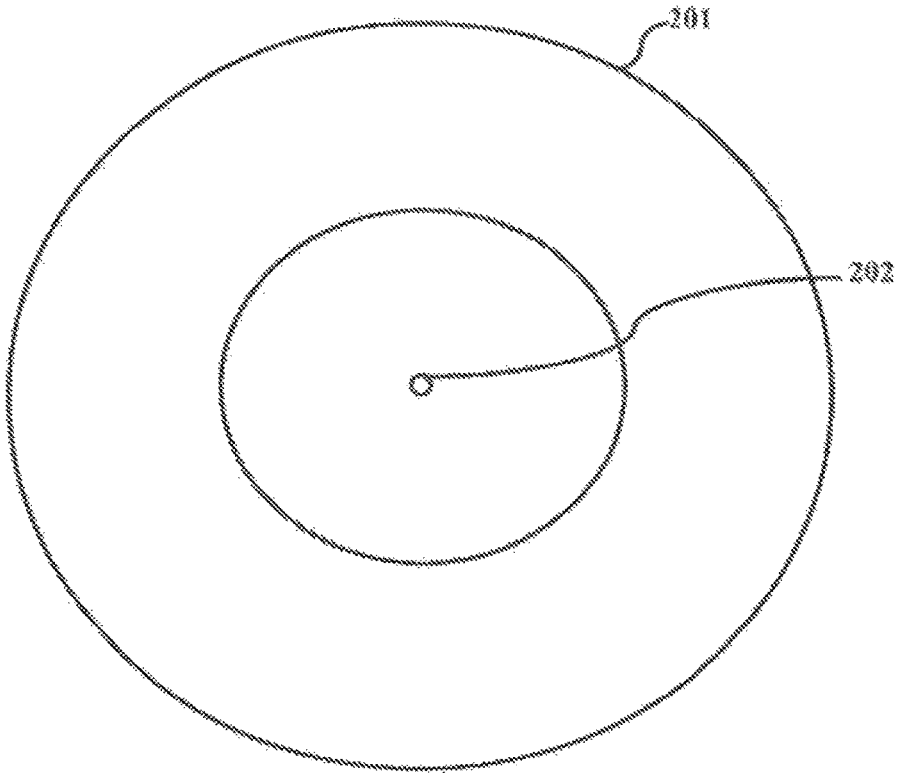
FIG. 7 illustrates a top view of a circular groove in a guitar body for fitting a spin wheel inside a guitar body, according to an embodiment herein.

FIG. 7 illustrates a top view of a circular groove in a guitar body for fitting a spin wheel inside an electric guitar, according to an embodiment herein. With respect to FIG. 7, a new spin wheel is fitted into the circular groove 201 by removing an old spin wheel of the guitar. Initially, the center screw 202 is removed from the guitar body and the strings of the guitar are loosened. Further, the old spin wheel is pulled out from the circular groove 201 and the new spin wheel is placed in the circular groove 201 of the guitar. The new spin wheel is fitted inside the circular groove 201 by tightening the center screw 202 and strings of the guitar.

Figure 8:
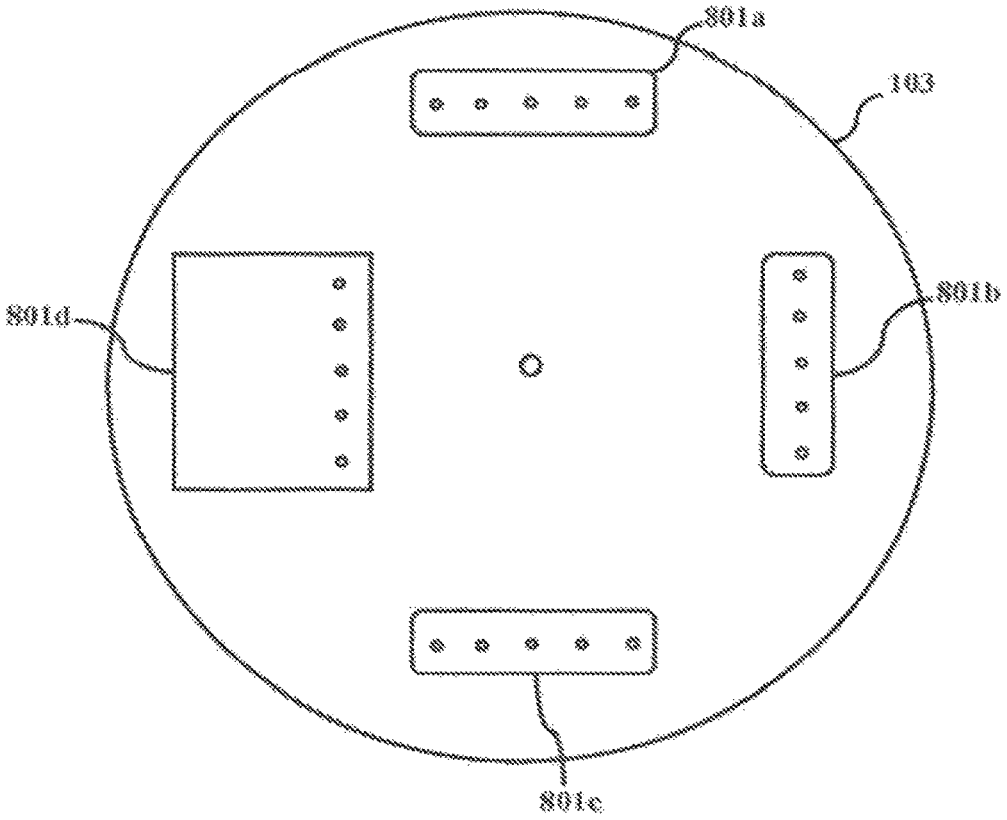
FIG. 8 illustrates a top view of a spin wheel in an electric guitar mounted with a plurality of favorite pickups, according to an embodiment herein.

FIG. 8 illustrates a top view of a spin wheel in an electric guitar mounted with various favorite pickups of a guitar player, according to an embodiment herein. With respect to FIG. 8, the pickup assembly of the spin wheel 103 comprises various favorite pickups 801*a*, 801*b*, 801*c*, and 801*d* of a guitar player. For example, the pickup 801*a* is a Lace sensor pickup, pickup 801*b* is a single coil pickup, pickup 801*c* is a P-90 pickup, and the pickup 801*d* is a humbucker pickup. Thus, the spin wheel 103 allows the guitar player to add favorite pickups for generating various tonalities beyond the limit of a single guitar.

Figure 9:
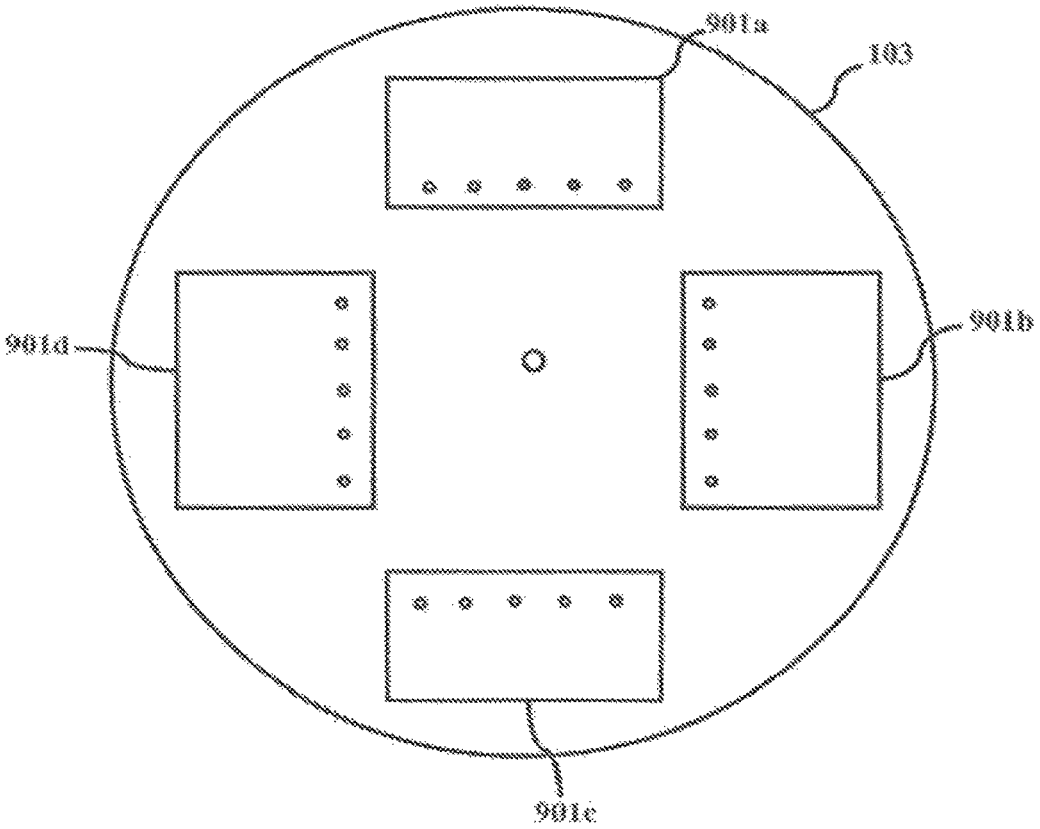
FIG. 9 illustrates a top view of a spin wheel in an electric guitar mounted with favorite humbucker pickups, according to an embodiment herein.

FIG. 9 illustrates a top view of a spin wheel in an electric guitar mounted with favorite humbucker pickups of a guitar player, according to an embodiment herein. With respect to FIG. 9, the guitar player adds favorite humbucker pickups in the spin wheel 103 for generating a plurality of humbucker tonalities. The pickup assembly of the spin wheel 103 comprises a plurality of humbucker pickups 901*a*, 901*b*, 901*c*, and 901*d* of the guitar player.

Figure 10:
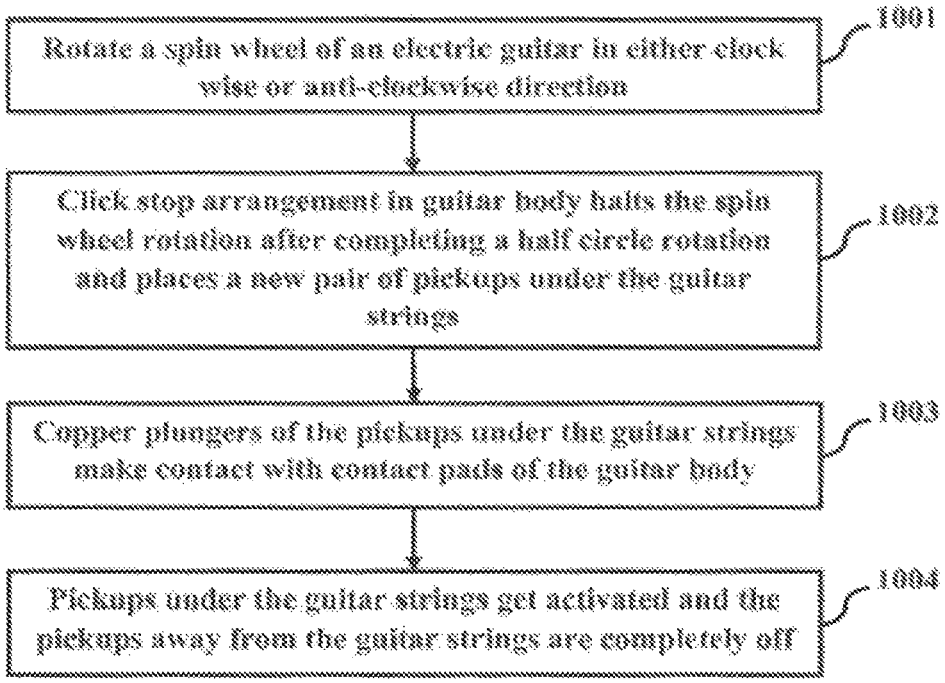
FIG. 10 illustrates a flowchart explaining a method of instantly switching sound pickups in an electric guitar through a spin wheel arrangement, according to an embodiment herein.

FIG. 10 illustrates a flowchart explaining a method of instantly switching sound pickups in an electric guitar through a spin wheel arrangement, according to an embodiment herein. A spin wheel is fitted in a circular groove of the guitar body using a center screw. The spin wheel houses a pickup assembly with a plurality of pickups. The spin wheel is rotated (1001) either in clock wise or counter clock wise direction while playing the guitar or in the middle of a song. A click stop arrangement in the guitar body brings the rotating spin wheel to a halt position after completing a half circle/semi-circular rotation around the center screw. In the halt position, a new pair of pickups are placed under the guitar strings (1002). The copper plungers of the corresponding pickups under the guitar strings make contact with contact pads of the guitar body (1003). The contact pads mate/engage with the copper plungers and establish electrical connections between the pickups and the electronic control components of the guitar. After establishing the electrical connection, the pickups under the guitar strings get activated and the pickups away from the guitar strings are completely off (1004). Thus, the spin wheel arrangement allows a guitar player to switch the pickups in the electric guitar instantly by rotating the spin wheel in the middle of a song.

The foregoing description of the specific embodiments will so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the appended claims.

Although the embodiments herein are described with various specific embodiments, it will be obvious for a person skilled in the art to practice the invention with modifications. However, all such modifications are deemed to be within the scope of the claims.

It is also to be understood that the following claims are intended to cover all of the generic and specific features of the embodiments described herein and all the statements of the scope of the embodiments which as a matter of language might be said to fall there between.

What is claimed is:

1. An electric guitar, said electric guitar comprising:

a guitar body, said guitar body comprising a circular groove for receiving a center-screw;

a spin wheel assembly, said spin wheel assembly rotatably mounted on the guitar body using the center-screw, said spin wheel assembly configured to be selectively rotated in a clock-wise direction and counter clock-wise direction while said electric guitar is being played, said spin wheel assembly comprising:

at least two pickups arranged on a horizontal axis thereof, and at least two pickups arranged on a vertical axis thereof; and said spin wheel assembly further configured to be selectively rotated across the guitar body while said electric guitar is being played, thereby activating either of the pickup heads located on the horizontal axis and the vertical axis, based on degree of rotation and direction of rotation thereof, said spin wheel assembly further configured to be rotated in a semi-circular manner across the guitar body, while said electric guitar is being played, to switch between said two pickups arranged on said horizontal axis and said two pickups arranged on said vertical axis, and wherein each of said pickups are connected to corresponding spring-loaded plungers via respective hot wires, said spring-loaded plungers operatively coupled to a plurality of contact pads thereby establishing an electrical connection between each of the pickups and electronic control components of the electric guitar.

2. The electric guitar as claimed in claim 1, wherein said spin wheel assembly further comprises a spin wheel, said spin wheel constructed as a combination of a top plate and a bottom plate held together by a plurality of screws, said pickups arranged on the horizontal axis and vertical axis of the top plate, said bottom plate incorporating said spring-loaded plungers.

3. The electric guitar as claimed in claim 1, wherein said circular groove forms a center stub on the guitar body, said center stub configured to receive the center-screw, and wherein said center stub provides an axis of rotation for the spin wheel assembly in the clock-wise direction and counter clock-wise direction.

* * * * *